US011871821B2

(12) United States Patent
Courter et al.

(10) Patent No.: US 11,871,821 B2
(45) Date of Patent: Jan. 16, 2024

(54) UNIVERSAL CASE FOR A TABLET DEVICE

(71) Applicant: UNITED STATES LUGGAGE COMPANY LLC, Hauppauge, NY (US)

(72) Inventors: Adam Courter, Long Beach, NY (US); Hayley Lawson, Long Beach, NY (US)

(73) Assignee: UNITED STATES LUGGAGE COMPANY LLC, Hauppauge, NY (US)

( * ) Notice: Subject to any disclaimer, the term of this patent is extended or adjusted under 35 U.S.C. 154(b) by 0 days.

(21) Appl. No.: 17/977,287

(22) Filed: Oct. 31, 2022

(65) Prior Publication Data

US 2023/0136222 A1 May 4, 2023

Related U.S. Application Data

(60) Provisional application No. 63/274,244, filed on Nov. 1, 2021.

(51) Int. Cl.

| | |
|---|---|
| ***A45C 11/00*** | (2006.01) |
| ***A45C 13/00*** | (2006.01) |
| ***A45C 13/02*** | (2006.01) |

(52) U.S. Cl.

CPC ..... *A45C 11/00* (2013.01); *A45C 13/002* (2013.01); *A45C 13/02* (2013.01); (Continued)

(58) Field of Classification Search

CPC ..... A45C 13/004; A45C 2011/002; A45C 2011/003; A45C 2200/10; A45C 2013/025; A45C 13/02; A45C 13/002; A45C 11/00

(Continued)

(56) References Cited

U.S. PATENT DOCUMENTS 8,731,626 B2 5/2014 Hung
9,004,275 B2 * 4/2015 Lee ..... H04B 1/3888 455/575.8

(Continued)

FOREIGN PATENT DOCUMENTS

CN 207835555 U 9/2018
TW M493232 U 1/2015

(Continued)

OTHER PUBLICATIONS

International Search Report dated Feb. 10, 2023, received in a corresponding foreign application, 6 pages.

*Primary Examiner* — Rafael A Ortiz
(74) *Attorney, Agent, or Firm* — Scully, Scott, Murphy & Presser, P.C.

(57) ABSTRACT

A universal case for an electronic tablet device is disclosed comprising a rectangular sectioning panel having a front surface and an unobstructed center portion, the sectioning panel divided into four quadrants by projections at intervals along the center lines of the sectioning panel, and a tablet holding assembly comprising four separate quadrant pieces having tablet gripping members, the pieces configured to fit within the sectioning panel quadrants where quadrant pieces diagonally opposite each other are joined by elastic members which permit the quadrant pieces to elastically separate to accommodate a particular tablet device while urging the pieces toward the center thereby providing a secure fit for the device.

17 Claims, 10 Drawing Sheets

(52) U.S. Cl.
CPC ... *A45C 2011/003* (2013.01); *A45C 2013/025* (2013.01); *A45C 2200/10* (2013.01)

(58) Field of Classification Search
USPC ..... 206/320
See application file for complete search history.

(56) References Cited

U.S. PATENT DOCUMENTS

| | | | | |
|---|---|---|---|---|
| 9,634,711 | B2 | 4/2017 | Sirichai | |
| 2013/0213838 | A1 | 8/2013 | Tsai et al. | |
| 2014/0034531 | A1* | 2/2014 | Wang | H04B 1/3888 206/320 |
| 2015/0068934 | A1* | 3/2015 | Armstrong | H04B 1/3888 206/320 |
| 2015/0068935 | A1* | 3/2015 | Kay | A45C 13/36 206/320 |
| 2015/0076020 | A1* | 3/2015 | Smith | A45C 11/00 206/320 |
| 2016/0135560 | A1* | 5/2016 | Yeh | H04B 1/3888 224/581 |
| 2016/0262513 | A1* | 9/2016 | O'Neill | H04M 1/185 |
| 2016/0366997 | A1* | 12/2016 | Sirichai | F16M 13/00 |
| 2018/0191392 | A1 | 7/2018 | Poon | |
| 2022/0035482 | A1* | 2/2022 | Williams | G06F 1/1626 |

FOREIGN PATENT DOCUMENTS

| | | | | |
|---|---|---|---|---|
| TW | M531172 | U | 11/2016 | |
| WO | WO-2014107702 | A1 * | 7/2014 | A45C 13/002 |

* cited by examiner

UNIVERSAL CASE FOR A TABLET DEVICE

CROSS REFERENCE TO RELATED APPLICATION

The present invention claims the benefit of U.S. Provisional Patent Application No. 63/274,244 filed Nov. 1, 2021, the entire content and disclosure of which is incorporated herein by reference.

FIELD

The disclosure relates to an electronic tablet device case that is adjustable to retain differently sized devices.

BACKGROUND

Tablet devices such as tablet computers, e-readers, and the like are available in different sizes. Often, cases for such devices are dimensioned for a particular size device. If a consumer has several such devices, separate cases for each need to be sought out and obtained, which cases they are not interchangeable among the disparate devices. Hence, a need for a universal case for a tablet device exists.

SUMMARY

In one embodiment the disclosure is directed to a universal case for an electronic tablet device comprising: a rectangular sectioning panel comprising a front surface having a center point, a front surface center portion surrounding the center point, and a rear surface, the front surface comprising a plurality of first projections at intervals along the x-axis of the centerline of the sectioning panel and a plurality of second projections at intervals along the y-axis of the centerline of the sectioning panel, the first and second projections dividing the front surface into four quadrants, the front surface center portion having no first and second projections; and a tablet holding assembly in contact with the front side of the sectioning panel and comprising four separate rectangular quadrant pieces each configured to fit within a respective quadrant of the front surface of the sectioning panel, wherein the quadrant pieces diagonally opposite each other are joined by a respective elastic member, the elastic members traversing the front surface center portion in an X configuration, each quadrant piece prevented from touching the edge of abutting quadrant pieces by a first or a second projection, and each quadrant piece having tablet gripping member on an outer edge.

DETAILED DESCRIPTION

The ensuing detailed description and reference to the figures is exemplary only and not restrictive of the scope of the disclosure.

Figure 1A:
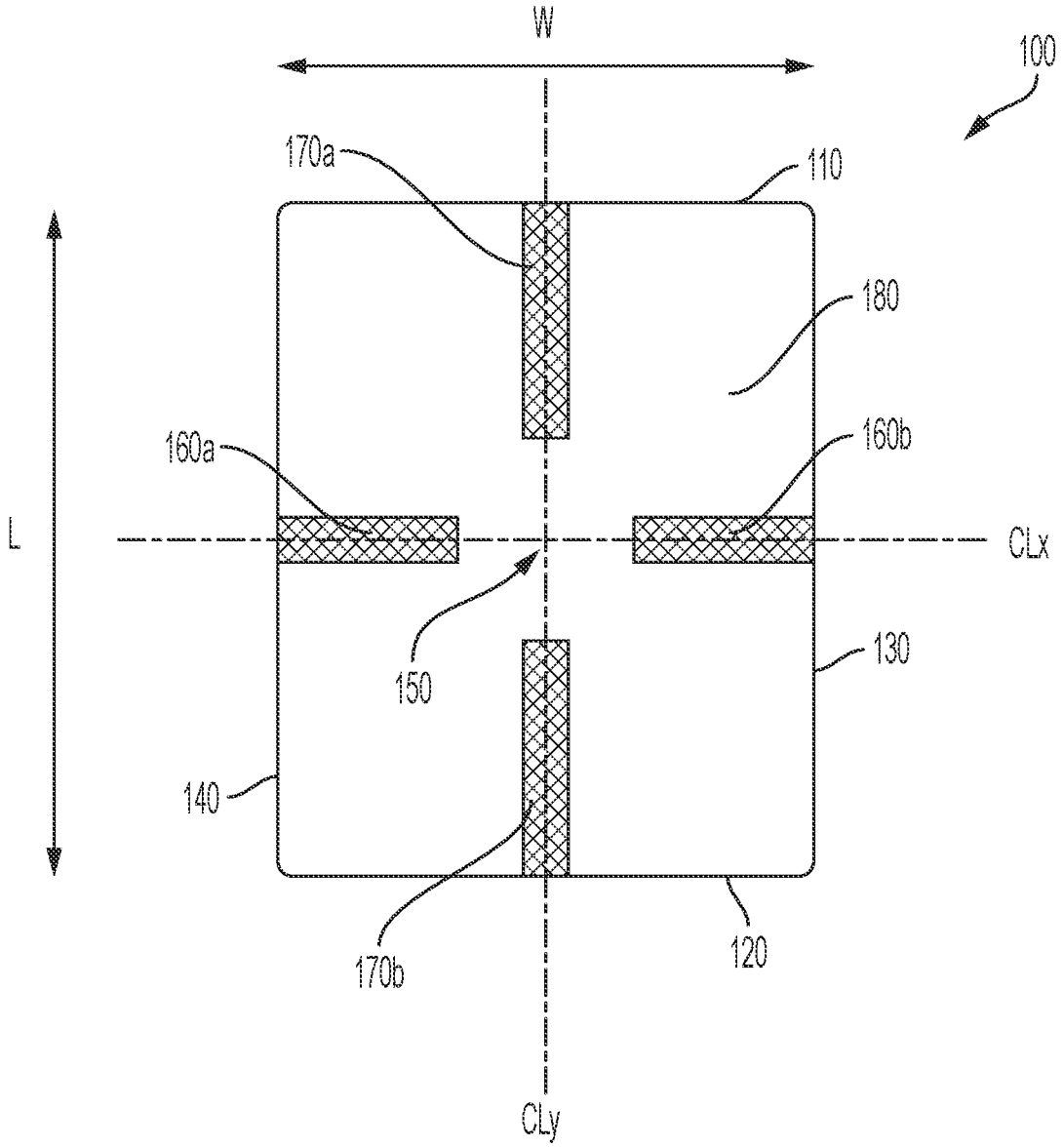
FIG. 1A is a top down plan view of the front surface of a rectangular sectioning panel embodiment of the disclosure.
Figure 1B:
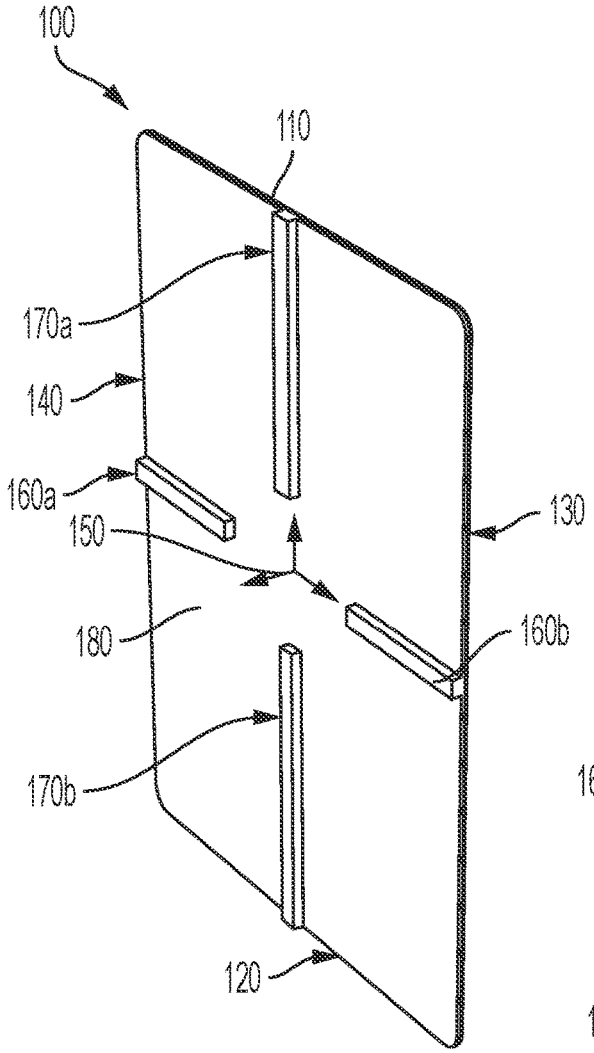
FIGS. 1B and 1C are perspective views of the front and rear surfaces of the embodiment of FIG. 1A.
Figure 1C:
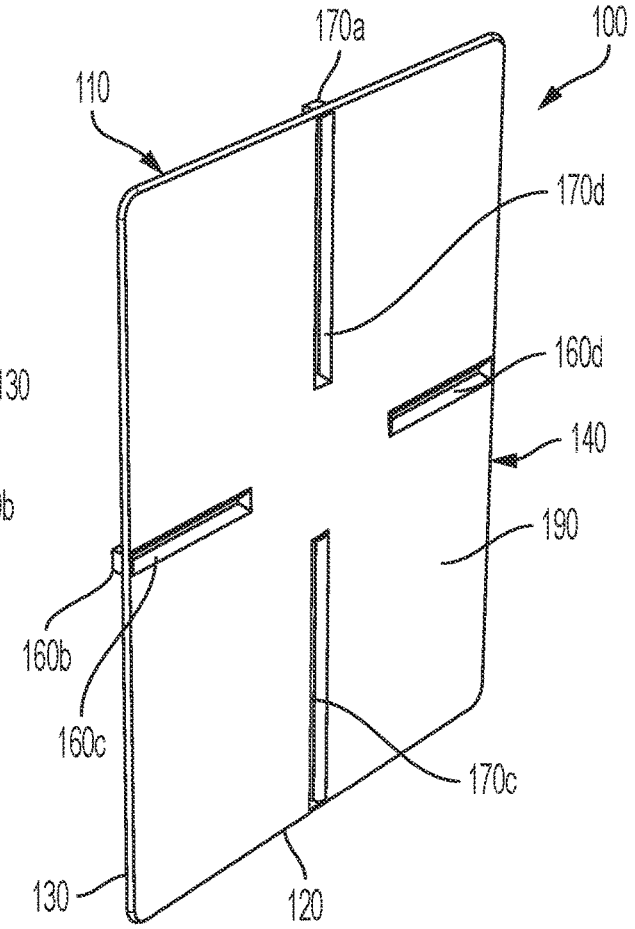

Referring to FIGS. 1A, 1B, and 1C thereat is an embodiment of a front surface 180 for a rectangular sectioning panel 100 of the disclosure. As used throughout herein "rectangular" includes square, substantially rectangular, and substantially square. Sectioning panel 100 has a length, L, and a width, W, and a centerline CLx along the x-axis bisecting the width W, and a centerline CLy along the y-axis bisecting the length L of panel 100. Panel 100 further has a top edge 110, a bottom edge 120 and opposing side edges 130 and 140. Panel 110 further comprises a front surface 180 and a rear surface 190. Front surface 180 comprises a center point 150 at the intersection of CLx and CLy, and a plurality of first projections 160*a* and 160*b* at intervals along the x-axis of centerline CLx, and a plurality of second projections 170*a* and 170*b* at intervals along the y-axis of centerline CLy.

In the practice depicted in FIGS. 1A and 1B, two first projections 106*a* and 106*b* and two second projections 170*a* and 170*b* are shown for convenience, it being understood that more than two first and second projections can be individually employed and the number of first and second projections can be the same or different. As depicted the first and second projections are ridges that are rectangular in cross section; other shapes for be employed, e.g. pegs and the shape of the first and second projections can be the same or different. In one practice as shown in FIGS. 1B and 1C, the first projections 160*a*, 160*b*, and the second projections 170*a* and 170*b* are embossed from the rear surface 190 so that they protrude outwardly from the front surface 180, the embossments for first projections 160*a* and 160*b* creating respective depressions 160*c* and 160*d* on rear surface 190, and the embossments for second projections 170*a* and 170*b* creating depressions 170*c* and 170*d*. In other practices the first and second projections can be integrally molded into the front surface 180 of the sectioning panel 100, or separately made and adhered to the front surface 180 by glue and the like.

The first and second projections divide the front surface 180 into four quadrants, 1, 2, 3, and 4, generally and respectively bounded by: 1) side edge 140, top edge 110, second projection 170*a* and first projection 160*a;* 2) side edge 140, bottom edge 120, second projection 170*b*, and first projection 160*a;* 3) bottom edge 120, side edge 130, second projection 170*b*, first projection 160*b*; and 4) side edge 130, top edge 110, first projection 160*b*, second projection 170*a*. The four quadrants may be of the same or different size. The front surface 180 comprises front surface center portion generally depicted in FIG. 1A as the cross-hatched area surrounding center point 150. The center portion can be symmetric or asymmetric. In one practice, the front surface center portion comprises up to 30% of the length of the sectioning panel, and, separately, up to 30% of the width of the sectioning panel; in another practice, the front surface center portion comprises up to 20% of the length of the sectioning panel and, separately, up to 20% of the width of the sectioning panel; in another practice, the front surface center portion comprises up to 10% of the length of the sectioning panel and, separately, up to 10% of the width of the sectioning panel.

Figure 4B:
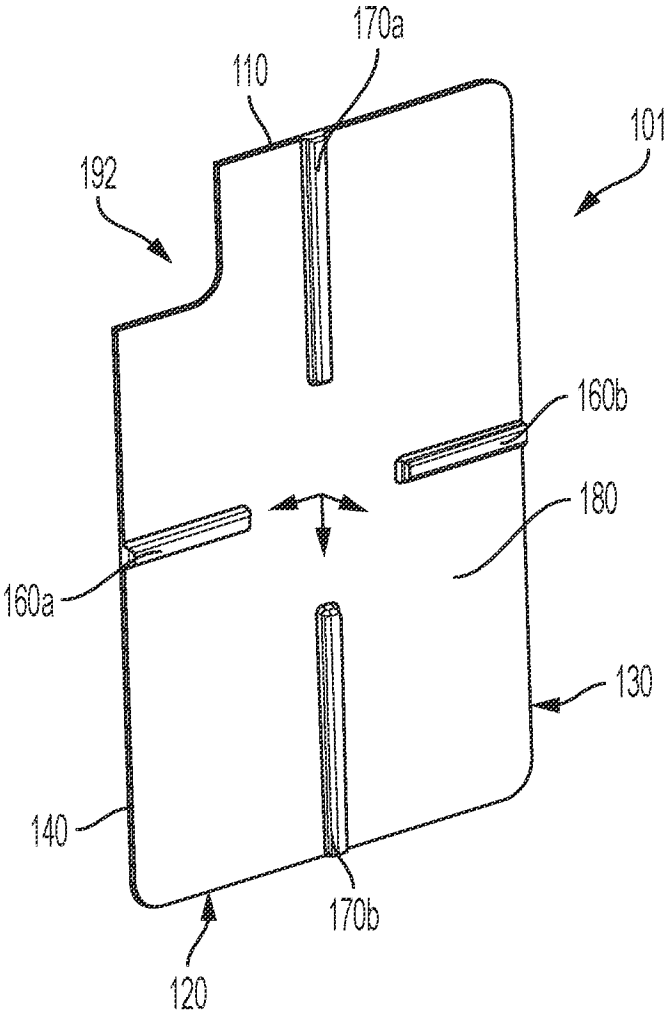
FIGS. 4A and 4B are perspective views of the front and rear surfaces of another embodiment of a rectangular sectioning panel of the disclosure comprising a camera window cut out.
Figure 4A:
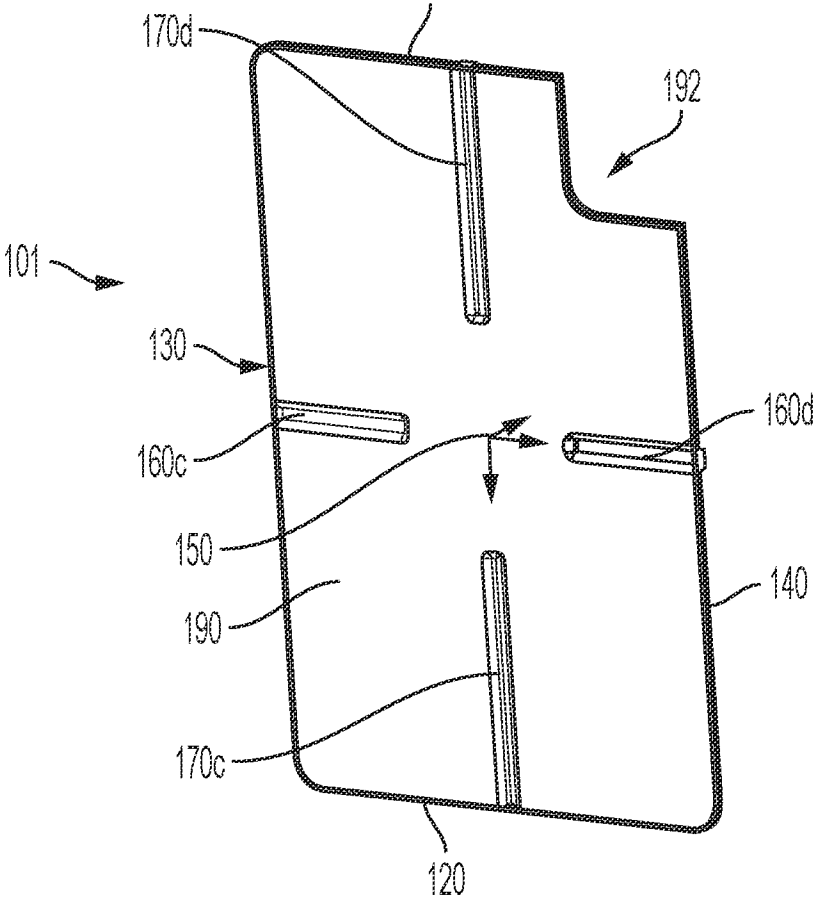

FIGS. 4A and 4B depict another embodiment of a rectangular sectioning panel 101 having the same features as shown for sectioning panel 100 of FIGS. 1A, 1B and 1C only sectioning panel 101 comprises a camera window 192 which is shown as a corner notch but can be an opening in the panel itself and can be located within the body of the panel.

Figure 2A:
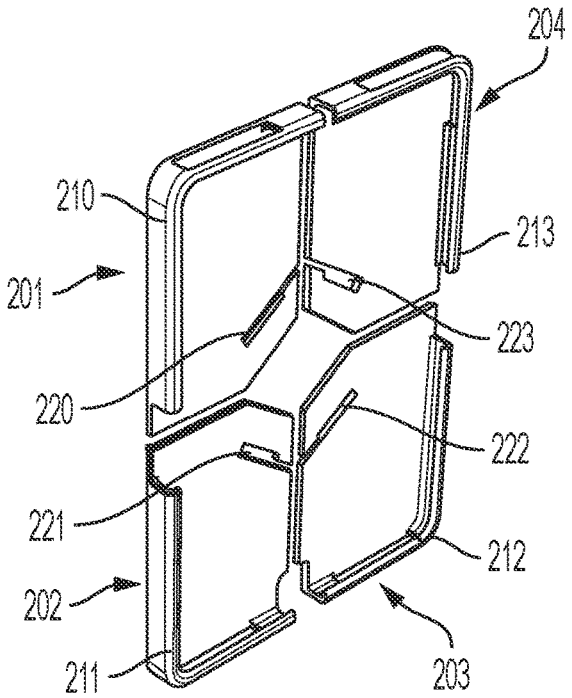
FIGS. 2A, 2*b*, and 2C are perspective views of an embodiment of quadrant pieces comprising the tablet holding assembly of the disclosure.
Figure 2B:
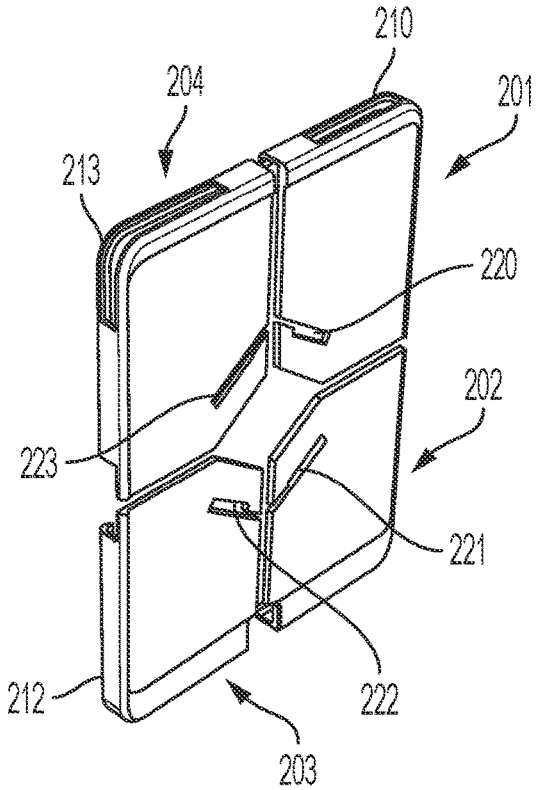
Figure 2C:
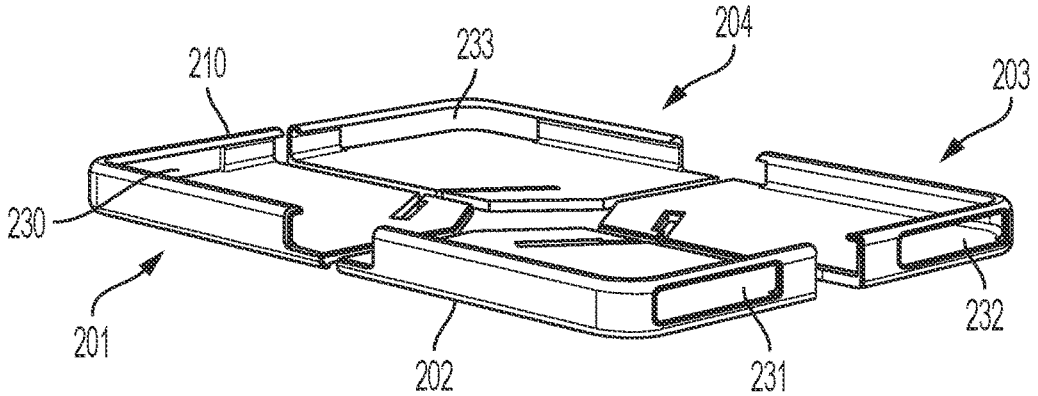

Referring to FIGS. 2A, 2B, 2C, thereat is an embodiment of rectangular quadrant pieces 201, 202, 203, and 204 each configured to fit within a respective quadrant of the front surface of the sectioning panel. Quadrant pieces 201 and 203, and 202 and 204, are diagonally opposite each other. The quadrant pieces may be of the same or different size and rectangular shape. In the optional practice shown, the corners of quadrant pieces 201 and 203, and 202 and 204, that are opposite each other have been truncated or beveled but need not be. Each quadrant piece comprises a tablet gripping member to secure the electronic tablet device to the case. Gripping members as known in the art are serviceable. In the practice depicted, gripping members 210, 211, 212 and 213 each comprise a flange that extends around the entire outer periphery of respective quadrant pieces 201, 202, 203, and 204, the flange configured to grip the corner and/or side of an electronic tablet device. In another practice, flanges may extend around only a portion of the outer periphery of a respective quadrant piece. As shown in the embodiment of FIGS. 2A, 2B, and 2C, the flanges may comprise one or more of openings 230, 231, 232, 233, configured to align with the location of speaker(s) and/or microphone(s) of an electronic tablet device.

Figure 3B:
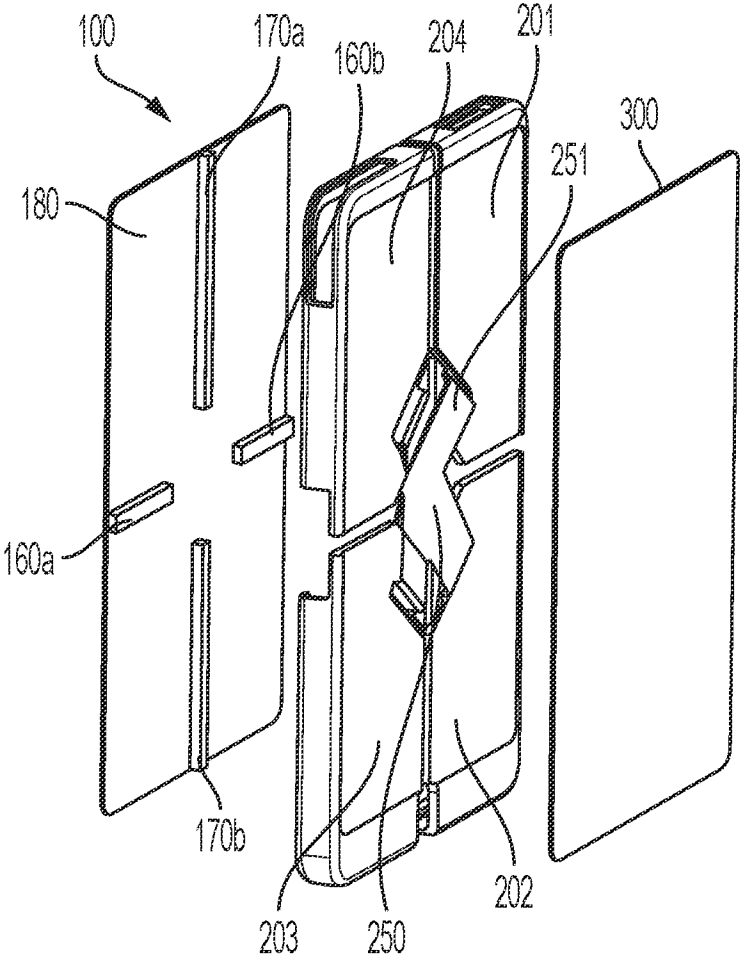
FIGS. 3A and 3B are exploded views of an embodiment of a universal tablet case of the disclosure comprising a fitted cover and the rectangular sectioning panel of FIG. 1A and the quadrant pieces of FIG. 2.
Figure 3A:
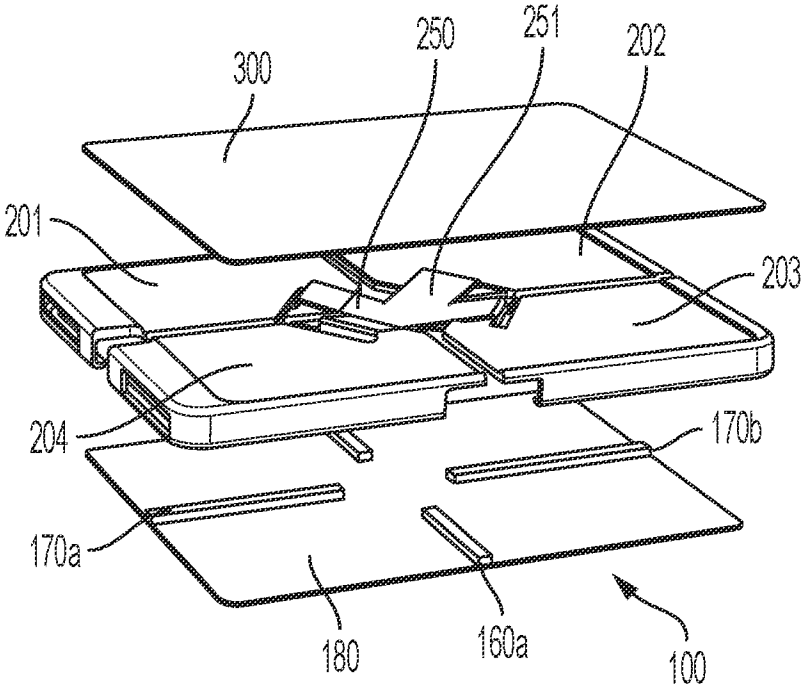
Figure 6B:
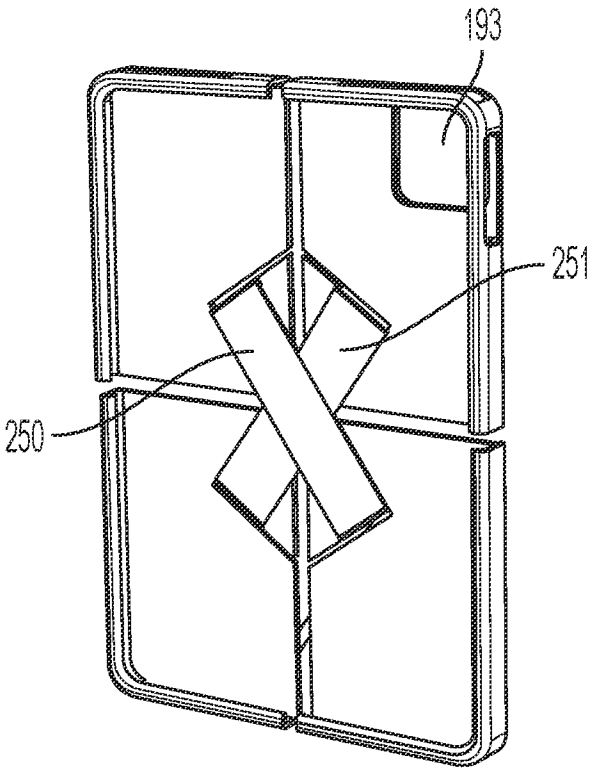
FIGS. 6A and 6B are perspective views of the quadrant pieces of FIG. 5 being assembled with elastic members and resulting tablet holding assembly.
Figure 6A:
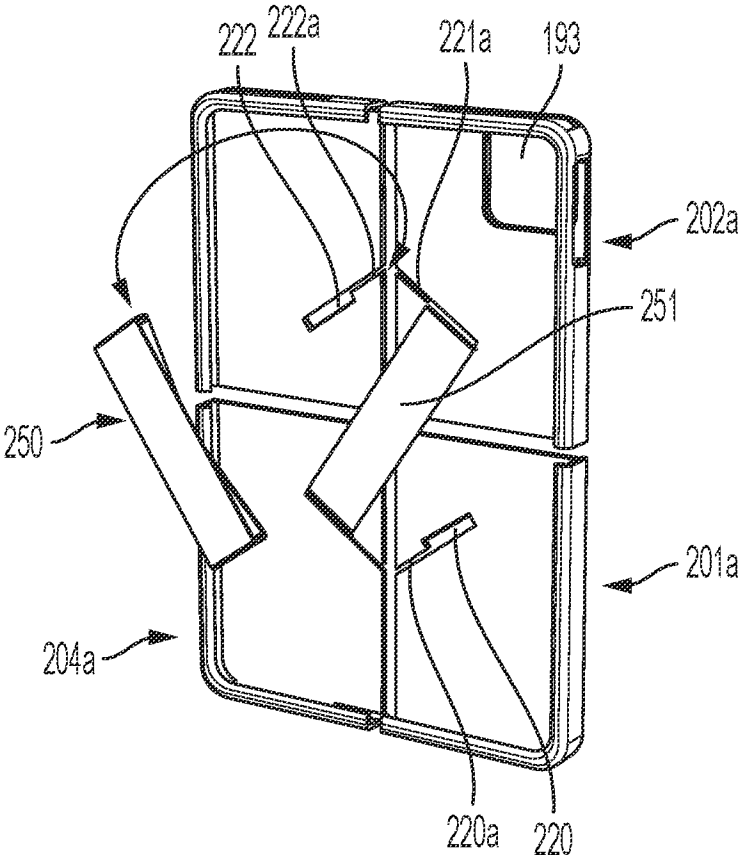

In the practice illustrated in FIGS. 2A, 2B, and 2C, and as depicted in FIGS. 3A and 3B, each of the quadrant pieces shown further comprise slots 220, 221, 22, and 223 through which a respective elastic member 250 and 251 is disposed. In the non-limiting embodiment depicted, slots 220, 221, 222, and 223 each have a side opening that extend to an edge of their respective quadrant piece, from which side opening they can be accessed to engage an elastic member, e.g. as depicted in FIGS. 6A and 6B. As illustrated, elastic member 250 joins diagonally opposite quadrant pieces 202 and 204 by being disposed through slots 221 and 223, whereas elastic member 251 joins diagonally opposite quadrant pieces 201 and 203 by being disposed through slots 220 and 224. Alternatively, the elastic members may be connected to the quadrant pieces by other means known in the art, e.g. by rivets, glue, and the like. The elastic members are configured to urge the opposing quadrant pieces toward the center point while stretching outward to accommodate differently sized electronic tablet devices. Suitable elastic members include those known in the art such as elastic bands, bungee cords and the like and may be the same or different.

FIGS. 3A and 3B illustrate the construction of the universal tablet case with the sectioning panel and quadrant pieces of FIGS. 1 and 2 wherein the front side 180 of rectangular sectioning panel 100 placed to be in contact with the tablet holding assembly comprising quadrant pieces 201, 202, 203, and 204 where opposite pieces 201 and 203, and 202 and 204 are joined as aforesaid by elastic members 250 and 251. Rectangular section panel 100 can be secured to the tablet holding assembly by stitching, glue and the like as known in the art. Back cover 300 is secured to the rear side of the tablet assembly, e.g. by a lip extending around the rear side of quadrant pieces 201, 202, 203, 204 configured to hold back cover 300. In another embodiment, cover 300 can be conjured as a wrap around cover having a flap portion configured to extend around and over the tablet holding assembly.

Figure 3D:
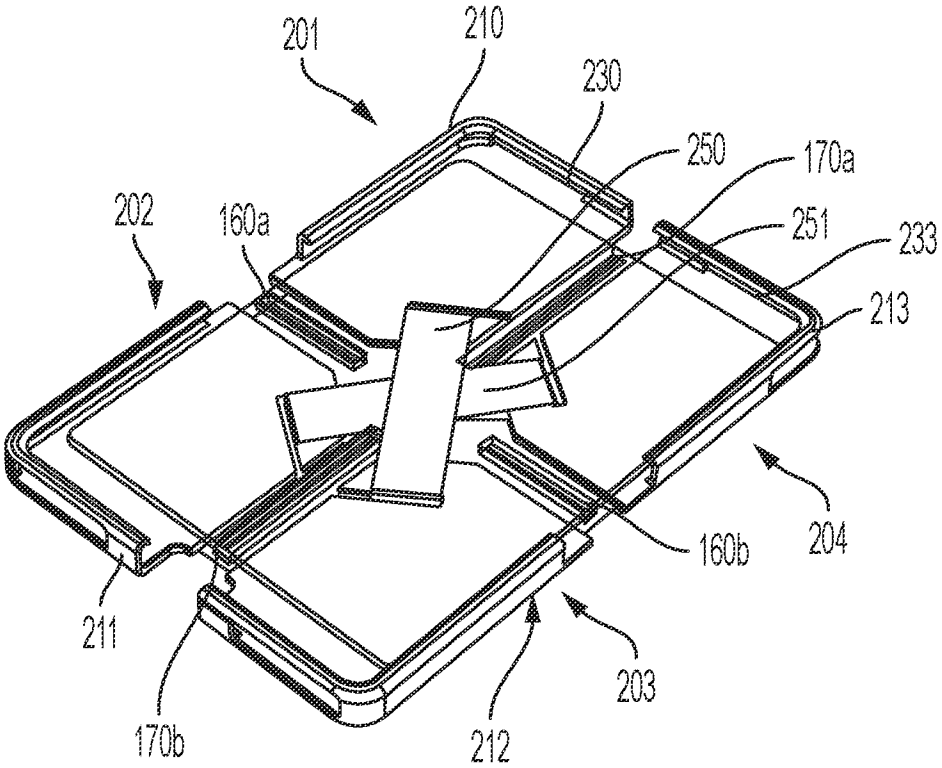
FIGS. 3C and 3D are top down plan and perspective views of the universal tablet case of FIGS. 3A and 3B as would be seen through the rectangular sectioning panel.
Figure 3C:
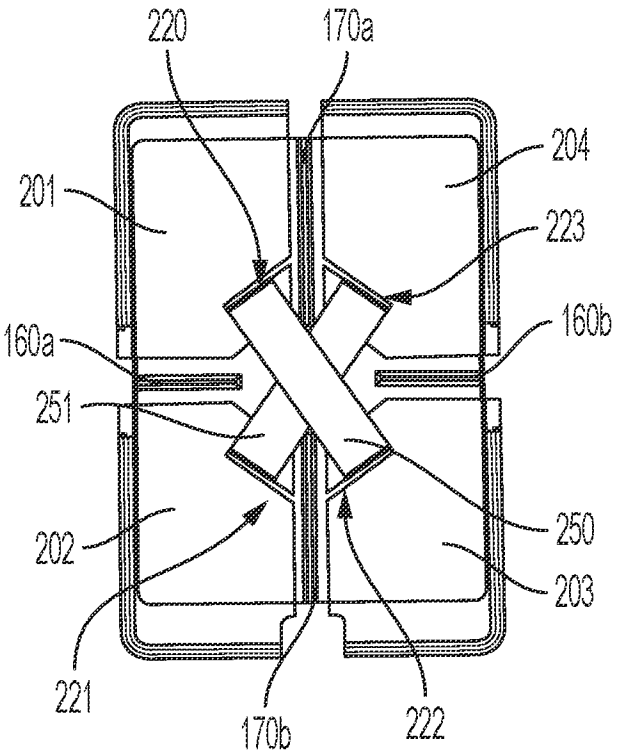

FIGS. 3C and 3D are representations of the universal case of the disclosure as would be seen through a transparent rectangular sectioning panel. Quadrant pieces 201 and 203 which are diagonally across from one another are joined together by elastic band 250 which is disposed within slots 220 and 222. Similarly, quadrant pieces 202 and 204 which are diagonally across from one another are joined together by elastic band 251 which is disposed within slots 221 and 223. First projection 160*a* prevents quadrant pieces 201 and 202 from touching each other whereas first projection 160*b* prevents quadrant pieces 203 and 204 from touching each other. Similarly, second projection 170*a* prevents quadrant pieces 201 and 204 from touching each other and second projection 170*b* prevents quadrant pieces 203 and 204 from touching each other. The depiction in FIGS. 3C and 3D show the quadrant pieces slightly stretched apart via elastic bands 250, 251.

Figure 5A:
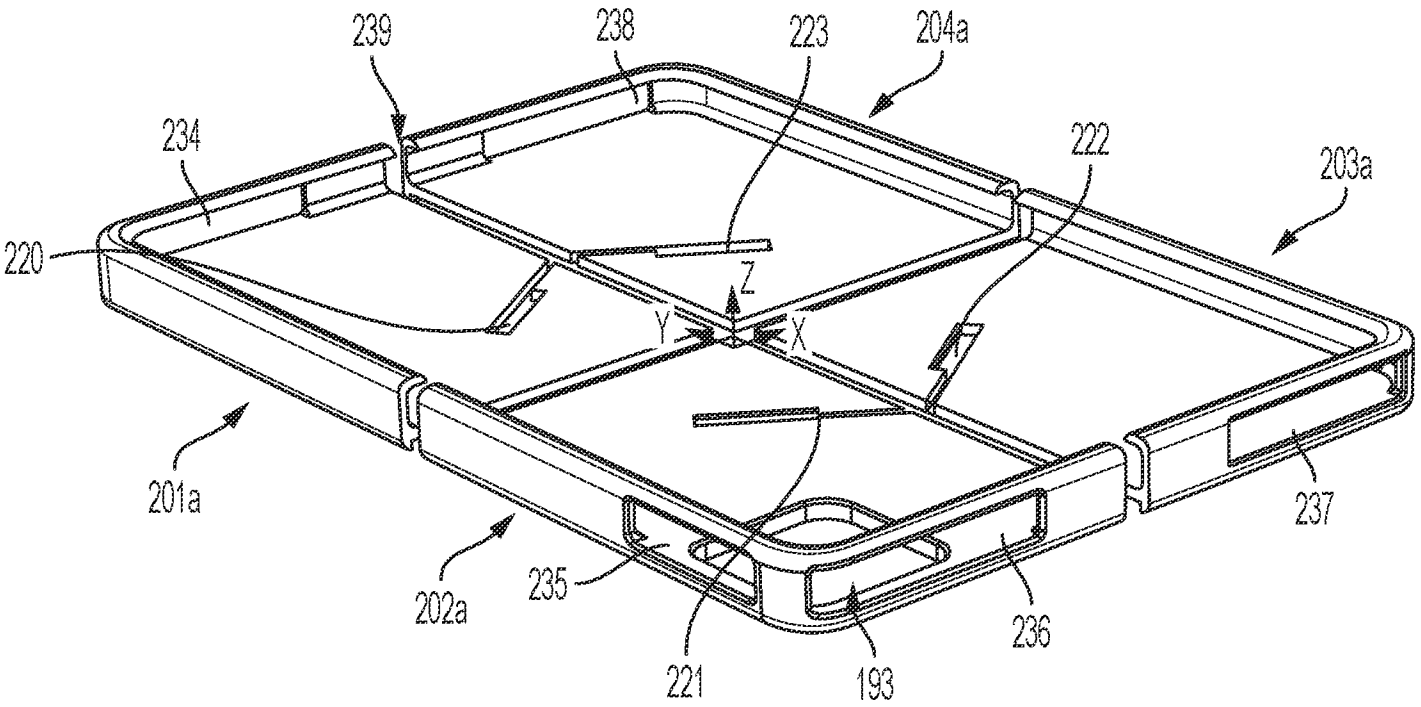
FIG. 5A is a top perspective view of another embodiment of quadrant pieces of the disclosure.
Figure 5B:
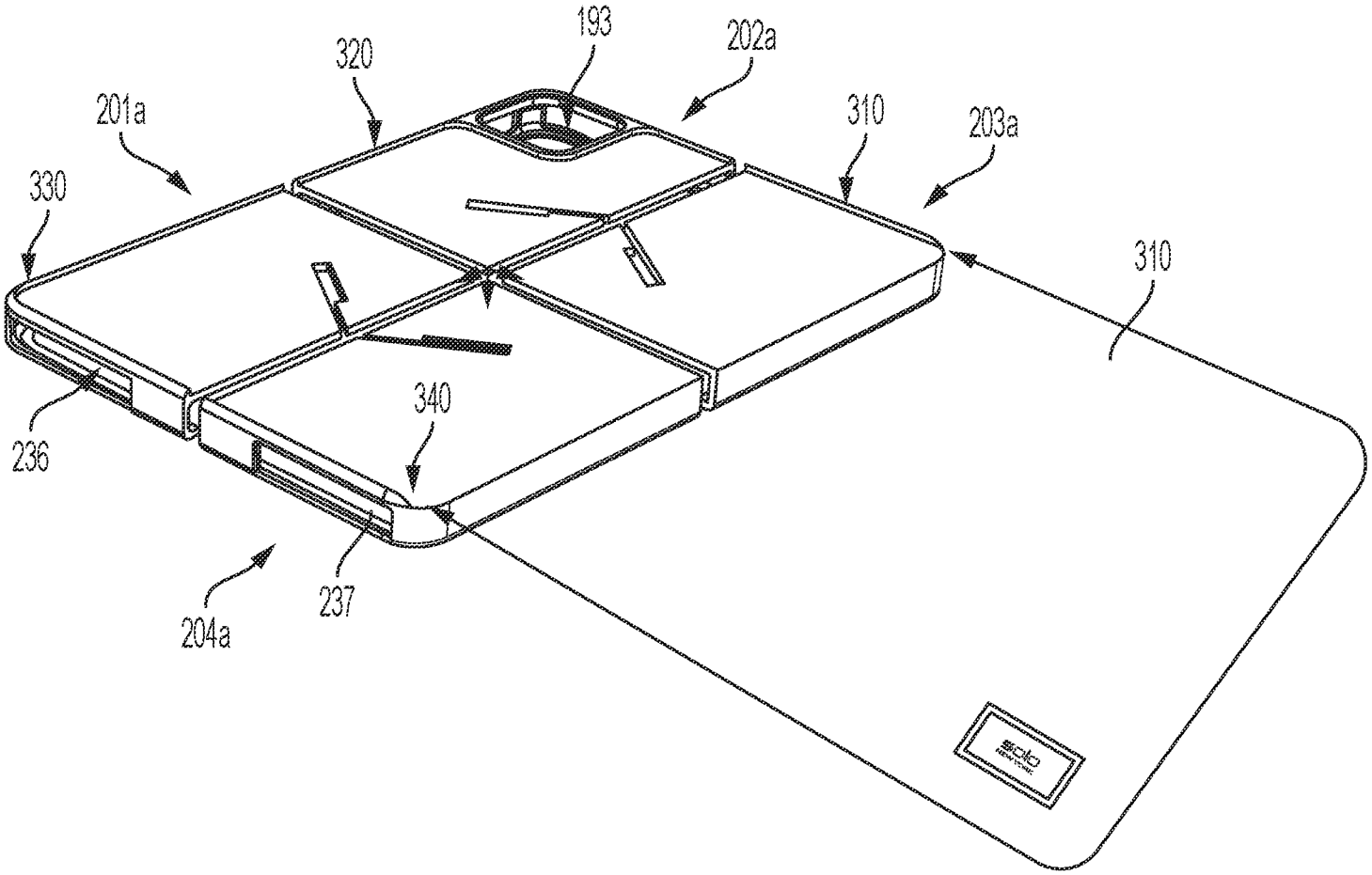
FIG. 5B is a perspective view of the rear side of the embodiment of FIG. 5A.

FIGS. 5A and 5B depict another embodiment of quadrant pieces 201*a*, 202*a*, 203*a*, and 204*a* of the disclosure. These do not have beveled corners proximate the center point and comprise camera opening 193, opening 235 for a volume button on an electronic tablet device; openings 234, 236, 237, and 238 for a speaker and/or microphone on an electronic table device; and opening 239 for a charging port on an electronic tablet device. FIG. 5B depicts the rear (opposite) side of the quadrant pieces of FIG. 5A and illustrates a practice wherein each quadrant piece comprises a lip 310, 320, 330 and 340 which is configured to accommodate cover 310 which would slide in under lips 310 and 340 and optionally be secured by means known in the art, e.g. stitching or glue and the like. Cover 310 would have a camera window (not shown) that would align with camera window 193.

Figure 7:
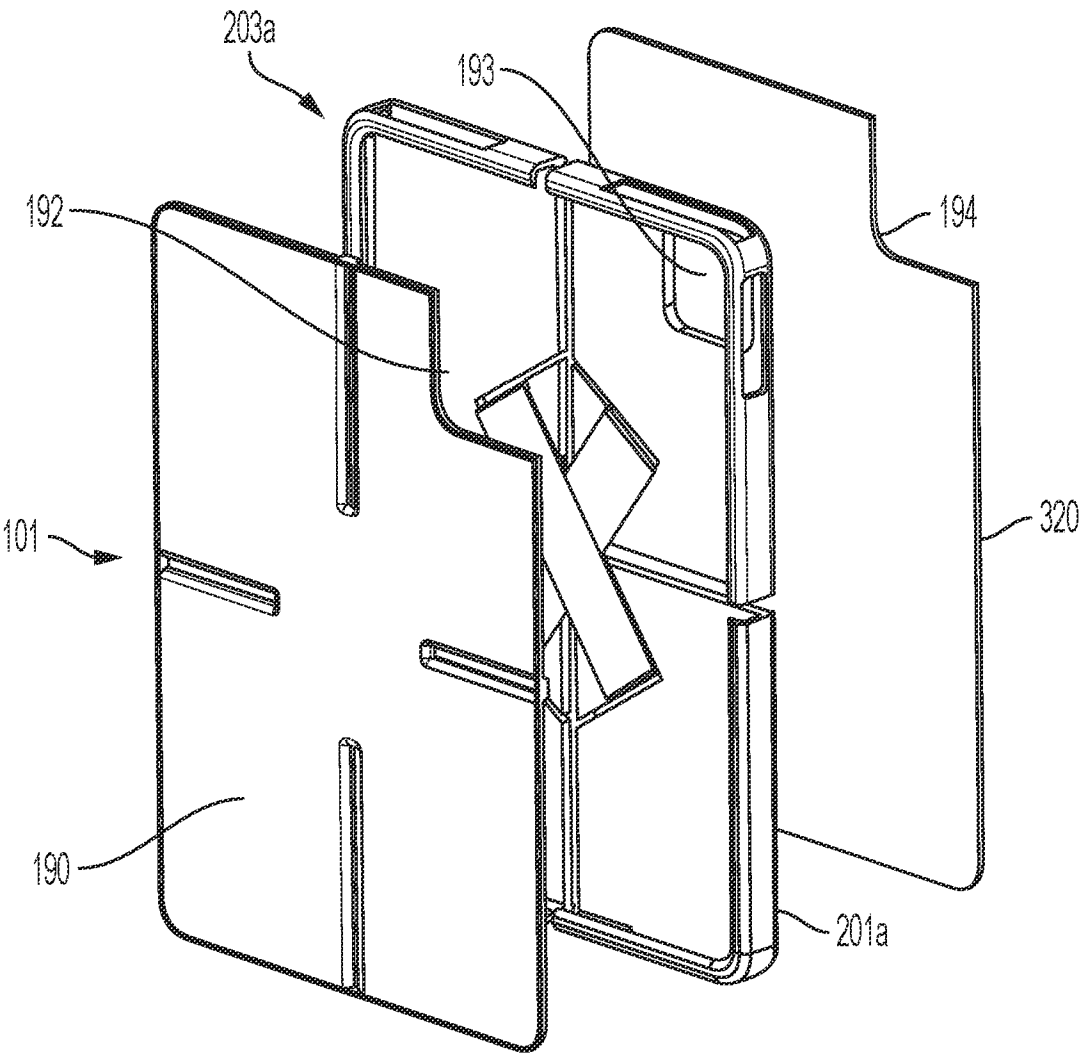
FIG. 7 is an exploded view of an embodiment of a universal tablet case of the disclosure comprising a fitted cover with the rectangular sectioning panel of FIG. 5 and the quadrant pieces and tablet assembly of FIG. 6 with a complementary aligned camera window.

FIGS. 6A and 6B depict an embodiment for the attachment of elastic members to create the tablet holding assembly, e.g. elastic band 250 is configured as a loop, one end of which is slipped into slot 222 via the side opening 222*a* whereas the other end of band 250 is slipped into slot 220 via its side opening 220*a*. FIG. 7 illustrates the construction of the universal tablet case with the sectioning panel and quadrant pieces of FIGS. 4, 5, and 6 wherein the front side 180 of rectangular sectioning panel 101 is placed to be in contact with the tablet holding assembly comprising quadrant pieces 201*a*, 202*a*, 203*a*, and 204*a* where opposite pieces 201*a* and 203*a*, and 202*a* and 204*a* are joined as aforesaid by elastic members 250 and 251. Rectangular section panel 101 can be secured to the tablet holding assembly by stitching, glue and the like as known in the art. In the practice shown, front cover 301, against which an electronic tablet device is placed, is fitted over the front surface of the tablet assembly and can be secured by means known in the art. Front cover 320 comprises camera window 194 which is configured to align with camera windows 192 and 193 of the sectioning panel and tablet assembly respectively.

What is claimed is:

1. A universal case for an electronic tablet device comprising:

a rectangular sectioning panel comprising a front surface having a center point, a front surface center portion surrounding the center point, and a rear surface, the front surface comprising a plurality of first projections at intervals along the x-axis of the centerline of the sectioning panel and a plurality of second projections at intervals along the y-axis of the centerline of the sectioning panel, the first and second projections dividing the rear surface into four quadrants, the front surface center portion having no first and second projections; and a tablet holding assembly in contact with the front side of the sectioning panel and comprising four separate rectangular quadrant pieces each configured to fit within a respective quadrant of the front surface of the sectioning panel, wherein the quadrant pieces diagonally opposite each other are joined by a respective elastic member, the elastic members traversing the front surface center portion in an X configuration, each quadrant piece prevented from touching the edge of abutting quadrant pieces by a first or second projection, and each quadrant piece having tablet gripping member on an outer edge.

2. The case of claim 1 wherein the plurality of first projections comprises two first projections, each separately disposed on opposite sides of the front surface center portion; and the plurality of second projections comprises two second projections, each separately disposed on opposite sides of the front surface center portion.

3. The case of claim 2 wherein the two first projections and the two second projections are each individually configured as ridges having the same size and shape.

4. The case of claim 3 wherein the ridges are rectangular in cross section.

5. The case of claim 1 wherein the front surface center portion comprises up to 30% of the length of the sectioning panel, and, separately, up to 30% of the width of the sectioning panel.

6. The case of claim 5 wherein the front surface center portion comprises up to 20% of the length of the sectioning panel and, separately, up to 20% of the width of the sectioning panel.

7. The case of claim 5 wherein the front surface center portion comprises up to 10% of the length of the sectioning panel and, separately, up to 10% of the width of the sectioning panel.

8. The case of claim 1 wherein the quadrant pieces diagonally opposite each other are joined at a point proximate their diagonally opposite corners by their respective elastic member.

9. The case of claim 8 wherein the quadrant pieces diagonally opposite each other each individually comprise a slot receiving an end of their respective elastic member.

10. The case of claim 1 wherein the elastic members each individually comprise an elastic band.

11. The case of claim 1 wherein each gripping member individually comprises (i) a flange extending around a portion of the outer periphery of a respective quadrant piece, (ii) a flange extending around the entirety of the outer periphery of a respective quadrant piece, (iii) a flange extending from the outer corner of a respective quadrant piece, or (iv) any combination of the foregoing.

12. The case of claim 1 wherein the four quadrants formed by the first and second projections each have the same size and shape; and the quadrant pieces each have the same size and shape.

13. The case of claim 1 further comprising a cover for the tablet holding assembly.

14. The case of claim 13 wherein the cover comprises a back portion disposed over and connected to the rear surface of the rectangular sectioning panel, and a flap portion which is configured to extend around and over the tablet holding assembly.

15. The case of claim 14 wherein the rear surface of the rectangular sectioning panel comprises a recessed area within which the back portion of the cover is disposed, the recessed area formed by a lip extending around the periphery of the rear surface, the recessed area configured to provide a flush fit with the back portion of the cover and the top of the lip.

16. The case of claim 1 wherein the sectioning panel and at least one quadrant piece comprise complementary aligned camera window cutouts.

17. The case of claim 1 wherein at least one quadrant piece comprises an opening for any one or more of the following: a speaker, a microphone, a volume button, or a charging plug of an electronic tablet device.

* * * * *